US006205906B1

(12) United States Patent
Suzuki et al.

(10) Patent No.: US 6,205,906 B1
(45) Date of Patent: Mar. 27, 2001

(54) RODLESS CYLINDER

(75) Inventors: Satoshi Suzuki; Mitsuhiro Someya; Shinichi Homma; Katsumi Iijima, all of Ibaraki-ken (JP)

(73) Assignee: SMC Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/176,117

(22) Filed: Oct. 21, 1998

(30) Foreign Application Priority Data

Dec. 2, 1997 (JP) ..... 9-331452

(51) Int. Cl.[7] ..... F01B 29/00
(52) U.S. Cl. ..... 92/88; 92/165 PR; 91/DIG. 4
(58) Field of Search ..... 92/161, 53, 88, 92/163, 165 R, 165 PR, 13.7, 5 R; 91/DIG. 4; 384/43

(56) References Cited

U.S. PATENT DOCUMENTS 4,123,121 * 10/1978 Ernst et al. ..... 384/43
4,744,287 * 5/1988 Miyamoto ..... 92/13.7

FOREIGN PATENT DOCUMENTS 9-273506 * 10/1997 (JP) .

* cited by examiner

*Primary Examiner*—Edward K. Look
*Assistant Examiner*—Thomas E. Lazo
(74) *Attorney, Agent, or Firm*—Paul A. Guss

(57) ABSTRACT

A rodless cylinder comprises a cylinder tube and guide shafts which are arranged in parallel to one another. The cylinder tube comprises a piston therein which is displaceable in the axial direction. Driving magnets are provided on outer circumference of the piston. A slider, which is displaceable in the axial direction, is provided on the guide shafts. The slider is supported on the guide shafts by the aid of ball bushes. Driven magnets, which correspond to the driving magnets, are provided in a hole of the slider. Inner circumferential surfaces of the driven magnets are slightly separated from an outer circumferential surface of the cylinder tube. Accordingly, it is unnecessary to apply any surface treatment to the cylinder tube, and it is possible to avoid appearance of dust or the like. It is unnecessary to assemble the rodless cylinder with a high degree of accuracy, and thus the production cost can be reduced.

9 Claims, 10 Drawing Sheets

RODLESS CYLINDER

BACKGROUND OF THE INVENTION

1. Field of the Invention

The present invention relates to a rodless cylinder for transporting workpiece or the like by displacing a slider in accordance with reciprocating motion of a piston.

2. Description of the Related Art

The rodless cylinder has been hitherto used, for example, for transporting a workpiece. The rodless cylinder basically comprises a piston which is inserted into a cylindrical cylinder tube slidably in its axial direction. A plurality of driving magnets are provided on the outer circumferential surface of the piston so that they face to the inner wall of the cylinder tube. On the other hand, a slider is slidably provided outside the cylinder tube so that is surrounds the cylinder tube. Driven magnets are arranged on the inner circumference of the slider so that they oppose to the driving magnets. When a pressure fluid such as compressed air is introduced into the cylinder tube, the piston is displaced in the axial direction in the cylinder tube. Accordingly, the driven magnets and the driving magnets are magnetically attracted to one another, and the slider slides outside the cylinder tube in accordance with the displacement of the piston.

In some cases, the rodless cylinder comprises a guide member which is disposed in parallel to the cylinder tube for guiding the slider.

In such a case, the outer circumference portion of the cylinder tube contacts with the driven magnets in the conventional rodless cylinder described above. Therefore, the sliding resistance is large, and it is feared that a bush for holding the driven magnets or the cylinder tube is worn to give rise to dust or the like. For this reason, a surface treatment is applied to the surface of the cylinder tube to decrease the sliding resistance in some cases. However, such a treatment has caused expensive production cost of the rodless cylinder. If the assembling accuracy is low for the cylinder tube and the guide member, then the sliding resistance is further increased, and it is feared that dust or the like is generated more frequently. Therefore, it is necessary to assemble the rodless cylinder with a high degree of accuracy, causing a problem that the production cost becomes more expensive.

SUMMARY OF THE INVENTION

A general object of the present invention is to provide a rodless cylinder which makes it possible to avoid any appearance of dust or the like and reduce the production cost without the need of assembling the rodless cylinder highly accurately.

A principal object of the present invention is to provide a rodless cylinder in which no surface treatment is required for a cylinder tube, and It is possible to avoid any appearance of dust or the like.

Another object of the present invention is to provide a rodless cylinder which makes it possible to avoid any appearance of dust or the like from a guide member.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

The rodless cylinder according to the present invention will be explained in detail below with reference to the accompanying drawings, as exemplified by preferred embodiments.

Figure 1:
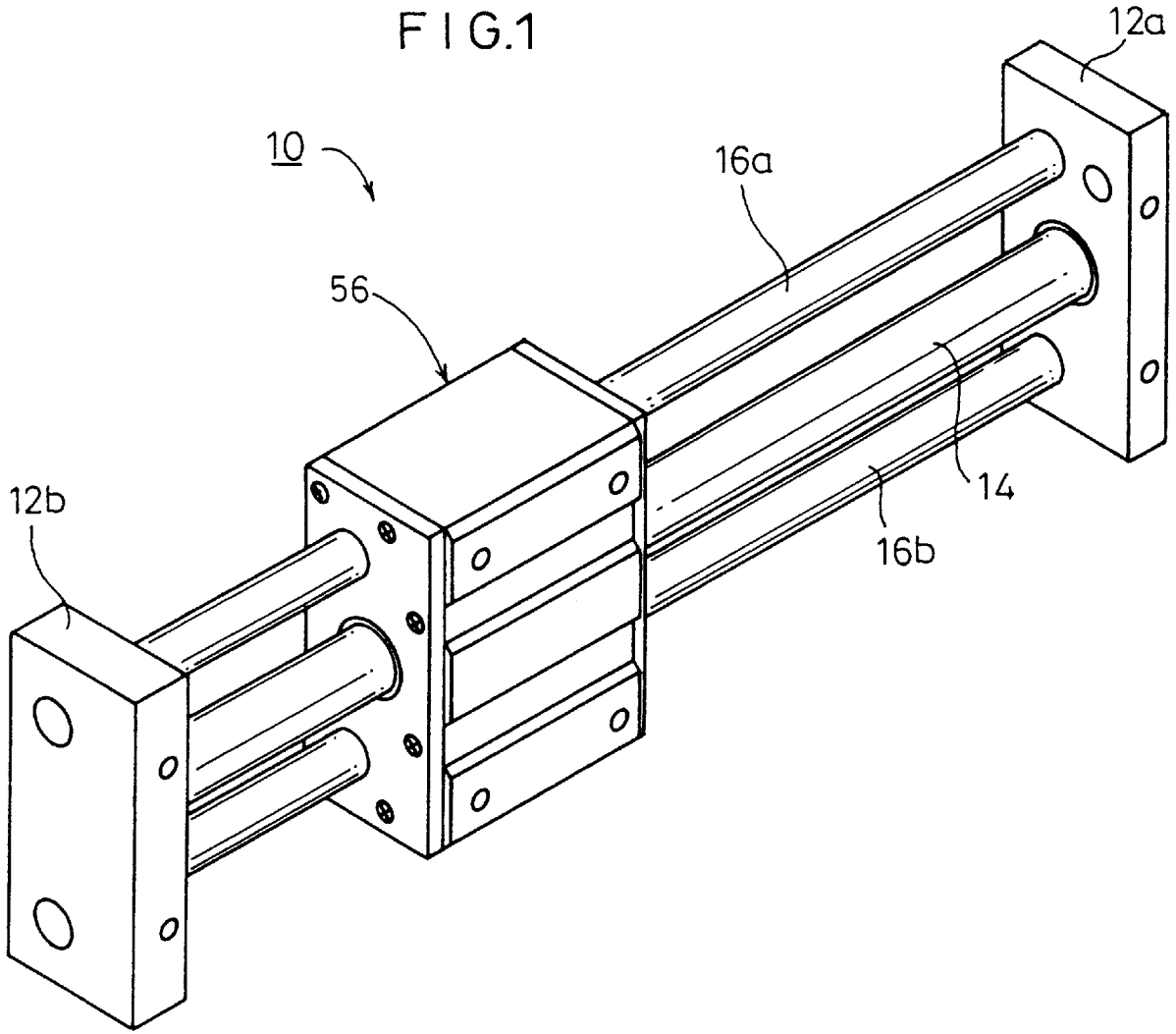
FIG. 1 shows a perspective view illustrating a rodless cylinder according to a first embodiment of the present invention.
Figure 2:
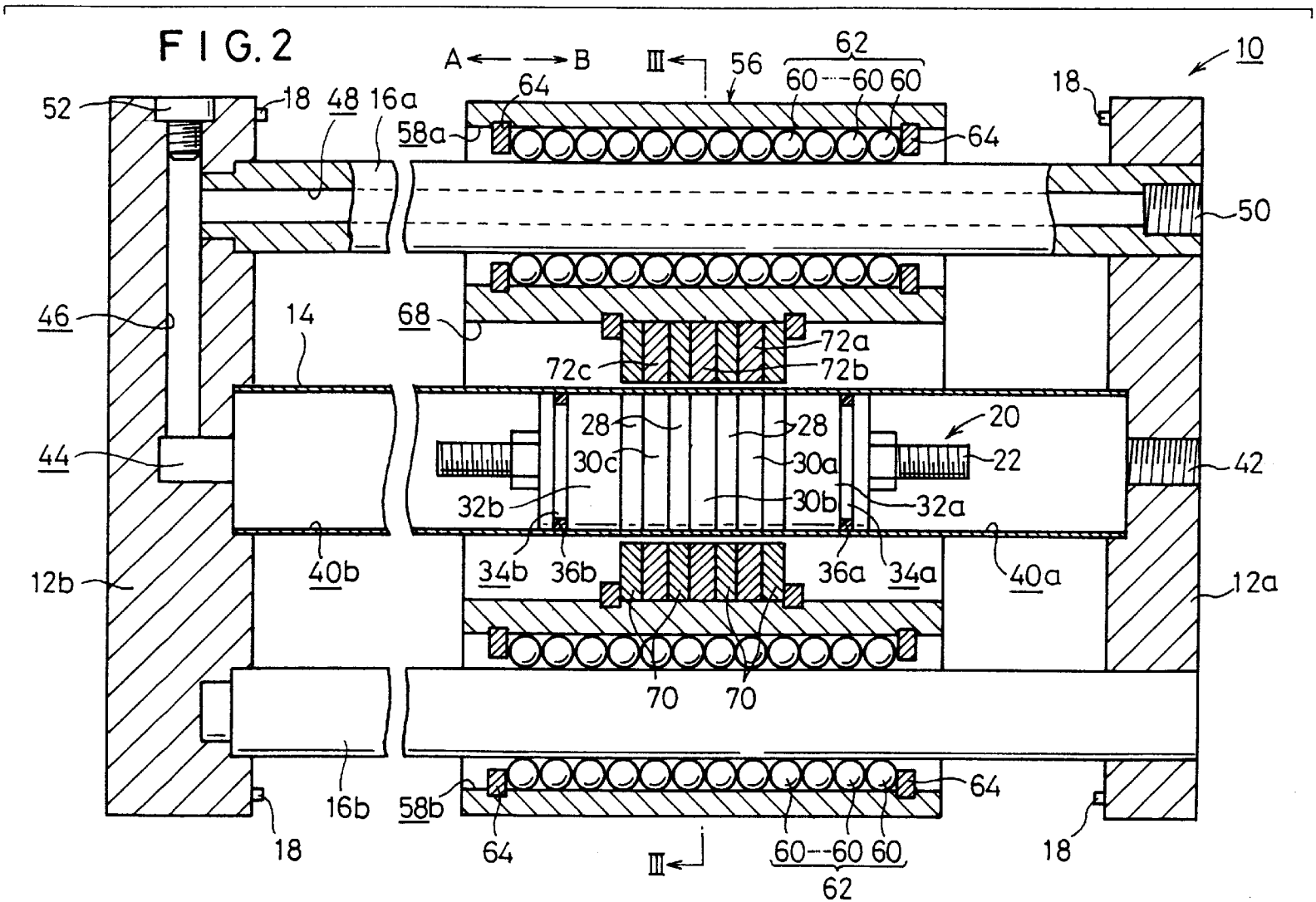
FIG. 2 shows a longitudinal sectional view illustrating the rodless cylinder shown in FIG. 1.
Figure 3:
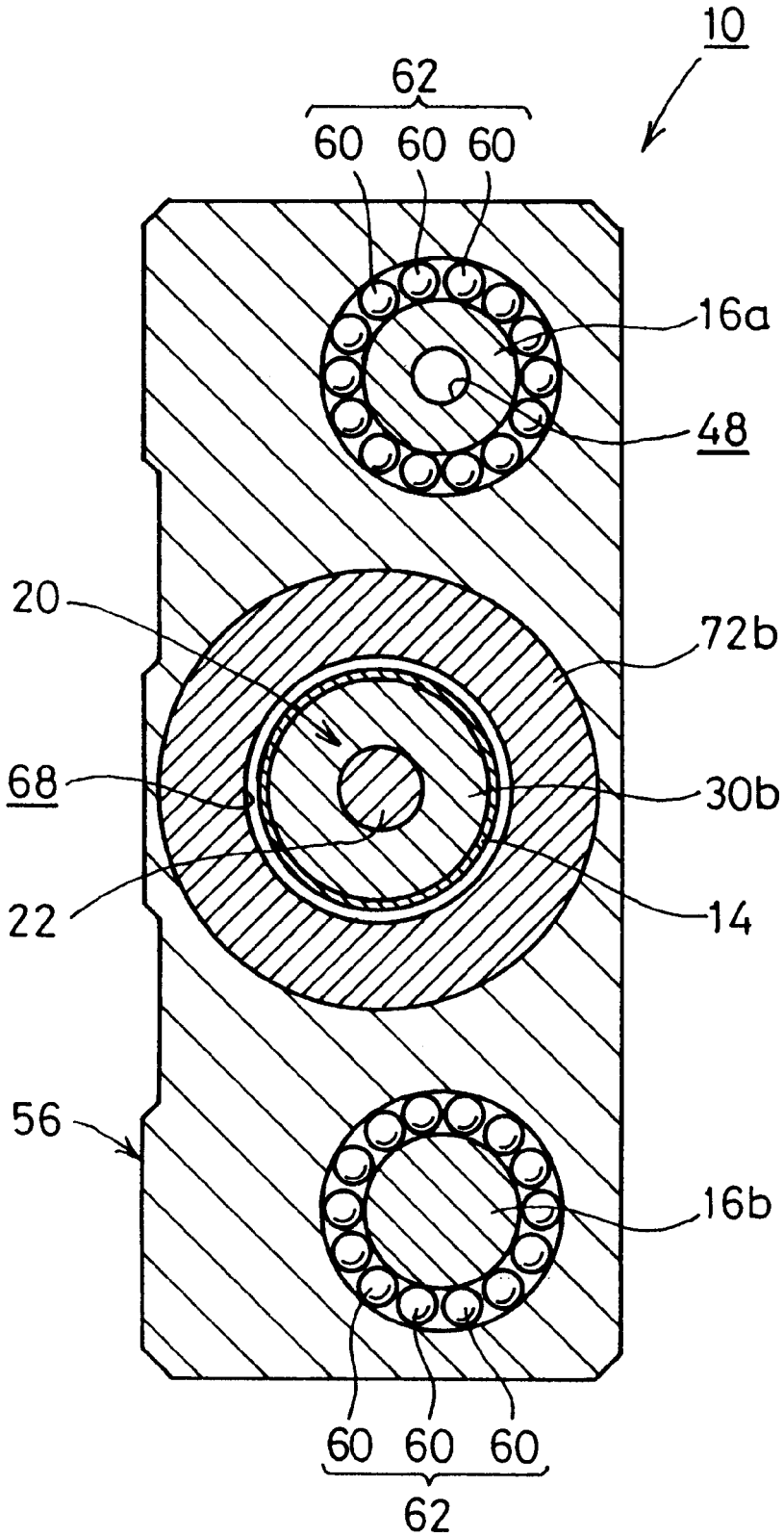
FIG. 3 shows a sectional view taken along a line III—III illustrating the rodless cylinder shown in FIG. 2.

With reference to FIGS. 1 to 3, reference numeral 10 indicates a rodless cylinder according to a first embodiment of the present invention. The rodless cylinder 10 comprises oblong plate-shaped members 12*a*, 12*b*. Both ends of a cylindrical cylinder tube 14 and guide shafts 16*a*, 16*b* for constructing guide members are secured to the plate-shaped member 12*a*, 12*b*. The cylinder tube 14 and the guide shafts 16*a*, 16*b* are arranged in parallel to one another. Dampers 18, which are formed of a material such as rubber, are secured to mutually opposing surfaces of the respective plate-shaped members 12*a*, 12*b*. The dampers 18 slightly protrude from the surfaces of the plate-shaped members 12*a*, 12*b* (see FIG. 2).

Figure 4:
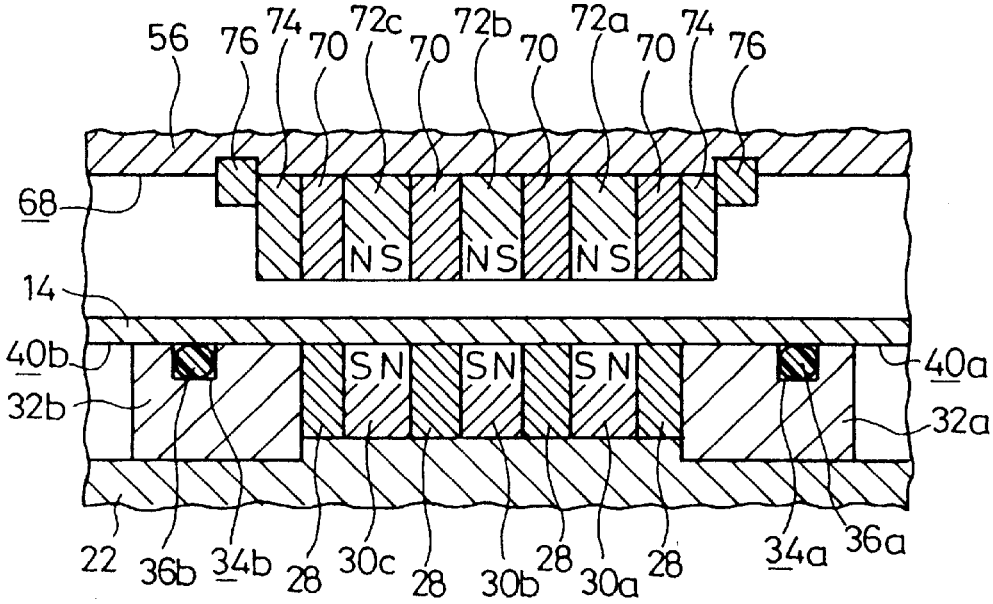
FIG. 4 shows a partial magnified sectional view illustrating the rodless cylinder shown in FIG. 2.

A piston 20 Is disposed in the cylinder tube 14, which is slidable in the axial direction of the cylinder tube 14. The piston 20 comprises a lengthy rod-shaped core member 22 which is disposed at the center of the piston 20 and which extends along the axial direction. As shown in FIG. 4, a plurality of ring members 28, which are formed of a material such as iron as magnetic members, are provided on the outer circumference of the core member 22. Driving magnets 30*a* to 30*c*, which have substantially the same diameter as that of the ring members 28, are interposed between the respective ring members 28. The respective driving magnets 30*a* to 30*c* are isolated from each other by the ring members 28. Each of the driving magnets 30*a* to 30*c* has one surface which is formed as the north pole, and the other surface which is formed as the south pole. Cylindrical members 32*a*, 32*b* are secured to the outer circumference of the core member 22 to interpose the ring members 28. Grooves 34*a*, 34*b* are defined on the outer circumference of the cylindrical members 32*a*, 32*b*. Packings 36*a*, 36*b* are arranged in the grooves 34*a*, 34*b*. A pressure fluid, which is introduced into the cylinder tube 14, is prevented from leakage by the aid of the packings 36*a*, 36*b*. Therefore, the inside of the cylinder tube 14 is divided into a first end chamber 40*a* and a second end chamber 40*b* by the piston 20.

As shown in FIG. 2, a first port 42, which communicates with the chamber 40*a*, is provided through one of the plate-shaped members 12*a*. The first port 42 communicates with an unillustrated compressed air supply source via an unillustrated solenoid-operated valve. A hole 44, which is coaxial with the cylinder tube 14, is defined at the inside of the other plate-shaped member 12*b*. The hole 44 communicates with a passage 46 which is defined along the longitudinal direction of the plate-shaped member 12*b*. The passage 46 further communicates with a passage 48 which is defined at the inside of one of the guide shafts 16*a* along its axial direction. A second port 50 is provided at an opening of the passage 48 disposed on the side of the one plate-shaped member 12*a*. The second port 50 communicates with the unillustrated compressed air supply source via an unillustrated solenoid-operated valve. Reference numeral 52 indicates a plug member for closing the passage 46.

A slider 56, which is slidable in the axial direction, is provided for the cylinder tube 14 and the guide shafts 16*a*, 16*b*. The slider 56 is defined with holes 58*a*, 58*b* through which the guide shafts 16*a*, 16*b* are inserted. Ball bushes 62, which include a large number of balls 60, are provided in gaps between walls for forming the holes 58*a*, 58*b* and outer walls of the guide shafts 16*a*, 16*b*. The ball bushes 62 are prevented from disengagement by the aid of retaining rings 64. Therefore, the slider 56 is supported on the guide shafts 16*a*, 16*b* by the aid of the ball bushes 62. The slider 56 is slidable with less friction in the axial direction.

Alternatively, for example, ball guide passages communicating with the holes 58*a*, 58*b* may be provided in the slider 56 to allow the balls 60 to circulate through the ball guide passages. This arrangement makes it possible to further reduce the sliding resistance of the balls 60, which is preferred.

The slider 56 is defined with a hole 68 through which the cylinder tube 14 is inserted. As shown in FIG. 4, a plurality of ring members 70, which are formed of a material such as iron and which have an inner diameter slightly larger than an outer diameter of the cylinder tube 14, are provided on a wall for forming the hole 68. The respective ring members 70 interpose a plurality of driven magnets 72*a* to 72*c*. Therefore, the driven magnets 72*a* to 72*c* are isolated from each other by the ring members 70. Each of the driven magnets 72*a* to 72*c* has one surface which is formed as the south pole, and the other surface which is formed as the north pole so that the polarity is opposite to that of the driving magnets 30*a* to 30*c*. Therefore, the driven magnets 72*a* to 72*c* and the driving magnets 30*a* to 30*c* are constructed so that they are attracted to one another. The driven magnets 72*a* to 72*c* and the ring members 70 are formed in an integrated manner, and they are prevented from disengagement by retaining rings 76 by the aid of support members 74.

Inner wall surfaces of the driven magnets 72*a* to 72*c* and the ring members 70 are formed to be slightly separated from the outer wall surface of the cylinder tube 14 owing to the fact that the slider 56 is supported by the guide shafts 16*a*, 16*b*.

The rodless cylinder 10 according to the first embodiment is basically constructed as described above. Next, its operation, function, and effect will be explained.

The unillustrated solenoid-operated valve is operated to introduce the compressed air into the first port 42, while the second port 50 is in a state open to the atmospheric pressure. The compressed air is introduced from the first port 42 into the chamber 40*a* of the cylinder tube 14. The pressure of the compressed air allows the piston 20 to slide in a direction indicated by the arrow A. Accordingly, the driving magnets 30*a* to 30*c* are displaced, and they magnetically attract the driven magnets 72*a* to 72*c*. Thus, the slider 56 slides along the guide shafts 16*a*, 16*b* in the direction of the arrow A. During this process, since the slight gap is provided between the driven magnets 72*a* to 72*c* and the outer circumferential surface of the cylinder tube 14, there is neither sliding resistance nor abrasion, and there is no fear of appearance of dust or the like. Since the guide shafts 16*a*, 16*b* are supported by the ball bushes 62, the sliding resistance is small, and it is possible to suppress any appearance of dust or the like.

When the piston 20 is further displaced in the direction of the arrow A, then the end of the slider 56 abut against the damper 18, and the slider 56 is positioned. Accordingly, the driving magnets 30*a* to 30*c* are attracted by the driven magnets 72*a* to 72*c*, and the piston 20 is prevented from further displacement exceeding this position in the direction of the arrow A.

Subsequently, the unillustrated solenoid-operated valve is operated so that the first port 42 is in a state open to the atmospheric air, and the compressed air is introduced into the second port 50. Accordingly, the compressed air is introduced into the chamber 40*b*, and the piston 20 slides in a direction of the arrow B. As a result, the driven magnets 72*a* to 72*c* are attracted to the driving magnets 30*a* to 30*c*, and the slider 56 is displaced in the direction of the arrow B.

If the rodless cylinder 10 involves any assembling error concerning the guide shafts 16*a*, 16*b* and the ball bushes 62, a part of the inner circumferential surface of the driven magnet 72*a* to 72*c* may approach the outer circumferential surface of the cylinder tube 14. In such a situation, It is sufficient for the driven magnet 72*a* to 72*c* to make no contact with the outer circumferential surface of the cylinder tube 14. Therefore, the assembling error for the guide shafts 16*a*, 16*b* and the ball bushes 62 is allowable provided that the error is within a range of the gap between the outer circumferential surface of the cylinder tube 14 and the inner circumferential surfaces of the driven magnets 72*a* to 72*c*.

Figure 5:
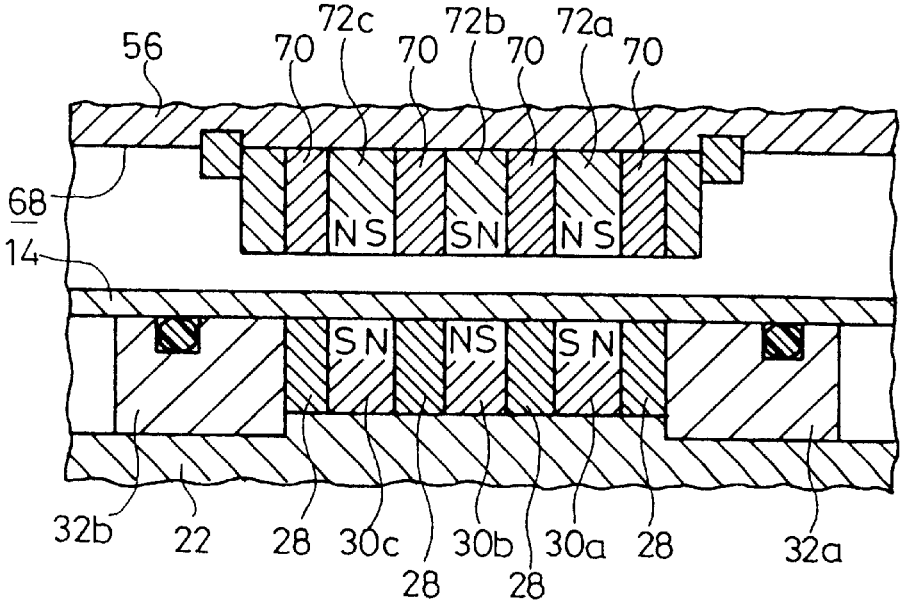
FIG. 5 shows a partial magnified sectional view illustrating a rodless cylinder according to a second embodiment of the present invention.

As shown in FIG. 4, in the rodless cylinder 10 according to the first embodiment, the driving magnets 30*a* to 30*c* are arranged so that all of their polarities are identically directed, and the driven magnets 72*a* to 72*c* are arranged so that their polarities are opposite to those of the driving magnets 30*a* to 30*c*. However, the following arrangement is available as illustrated in a second embodiment shown in FIG. 5. That is, the polarity of the driving magnet 30*b* arranged at the center may be opposite to those of the other driving magnets 30*a*, 30*c*, and the polarity of the driven magnet 72*b* may be opposite to those of the driven magnets 72*a*, 72*c* corresponding to the driving magnet 30*b*.

As described above, according to the rodless cylinders 10 concerning the first and second embodiments, the cylinder tube 14 is slightly separated from the driven magnets 72*a* to 72*c*. Accordingly, there is no fear of appearance of dust or the like due to abrasion. The rodless cylinder 10 can be used, for example, for those concerning the medical field and food as well as clean rooms.

Since the guide shafts 16*a*, 16*b* are supported by the ball bushes 62, the sliding resistance is decreased. Further, it is unnecessary to apply any surface treatment to the cylinder tube 14, and it is unnecessary to assembly the rodless cylinder 10 with a high degree of accuracy. Thus, it is possible to reduce the production cost.

Next, a rodless cylinder 100 according to a third embodiment will be explained with reference to FIGS. 6 to 8. The same constitutive components as those of the first embodiment are designated by the same reference numerals, detailed explanation of which will be omitted. Description will be made in this way for the following other embodiments as well.

The rodless cylinder 100 according to the third embodiment comprises a piston 20 which is provided with bushes

102*a*, 102*b* disposed on the outer circumference of cylindrical members 32*a*, 32*b*. The bushes 102*a*, 102*b* slidably abut against the inner wall of the cylinder tube 14. Thus, the ring members 28 and the driving magnets 30 are supported so that they are slightly separated from the inner wall of the cylinder tube 14.

Figure 6:
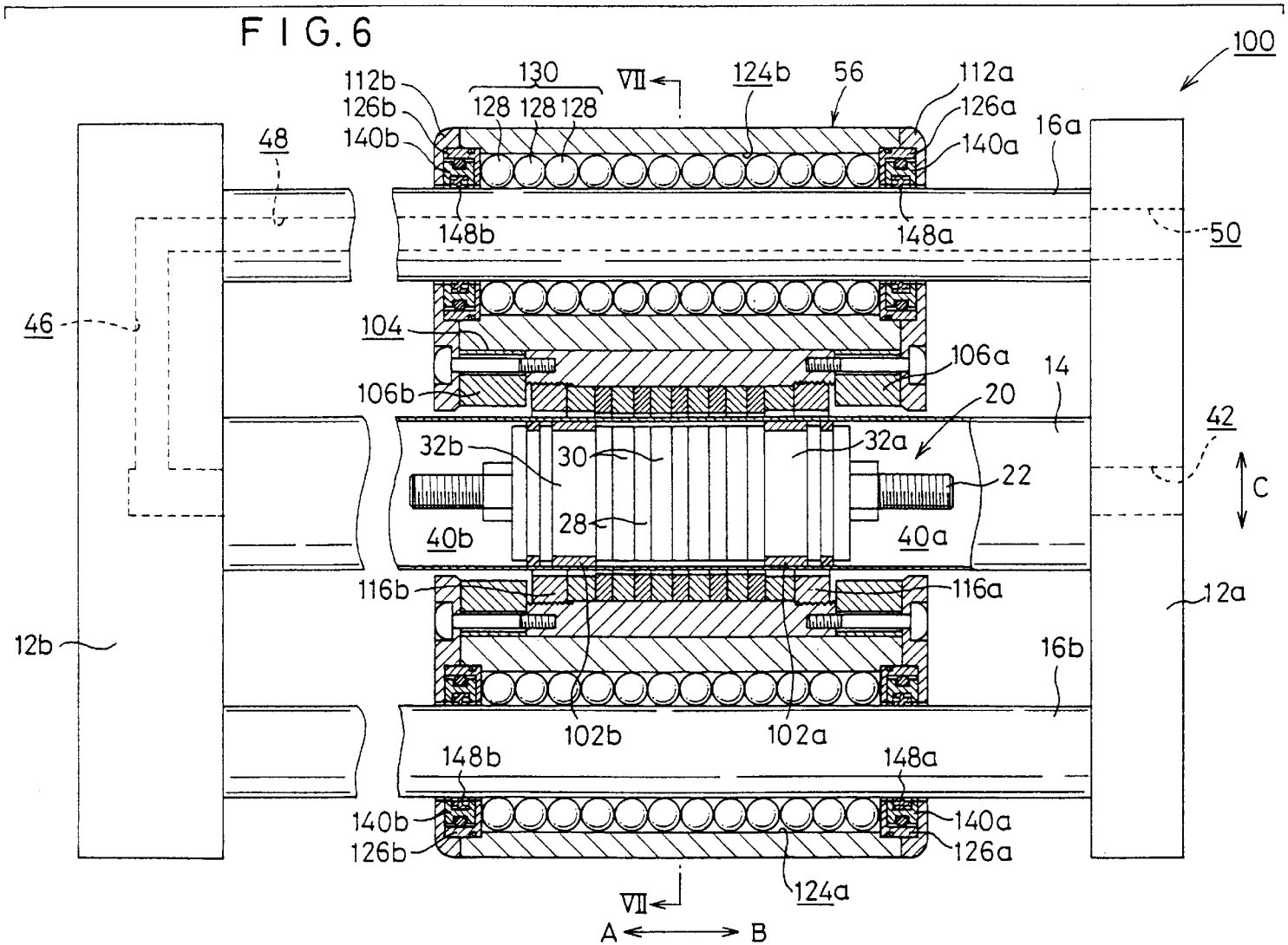
FIG. 6 shows a longitudinal sectional view illustrating a rodless cylinder according to a third embodiment of the present invention.
Figure 7:
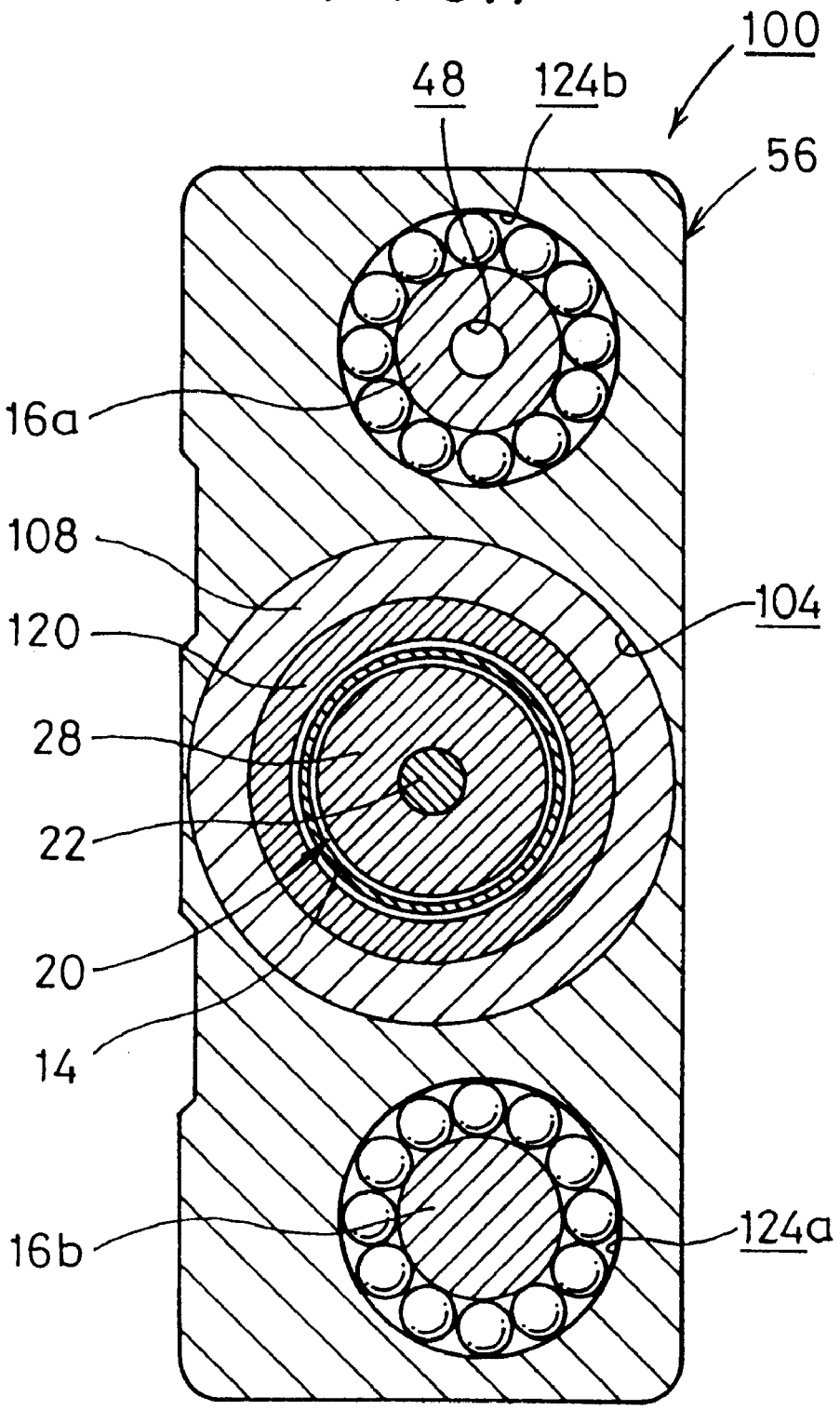
FIG. 7 shows a sectional view taken along a line VII—VII illustrating the rodless cylinder shown in FIG. 6.
Figure 8:
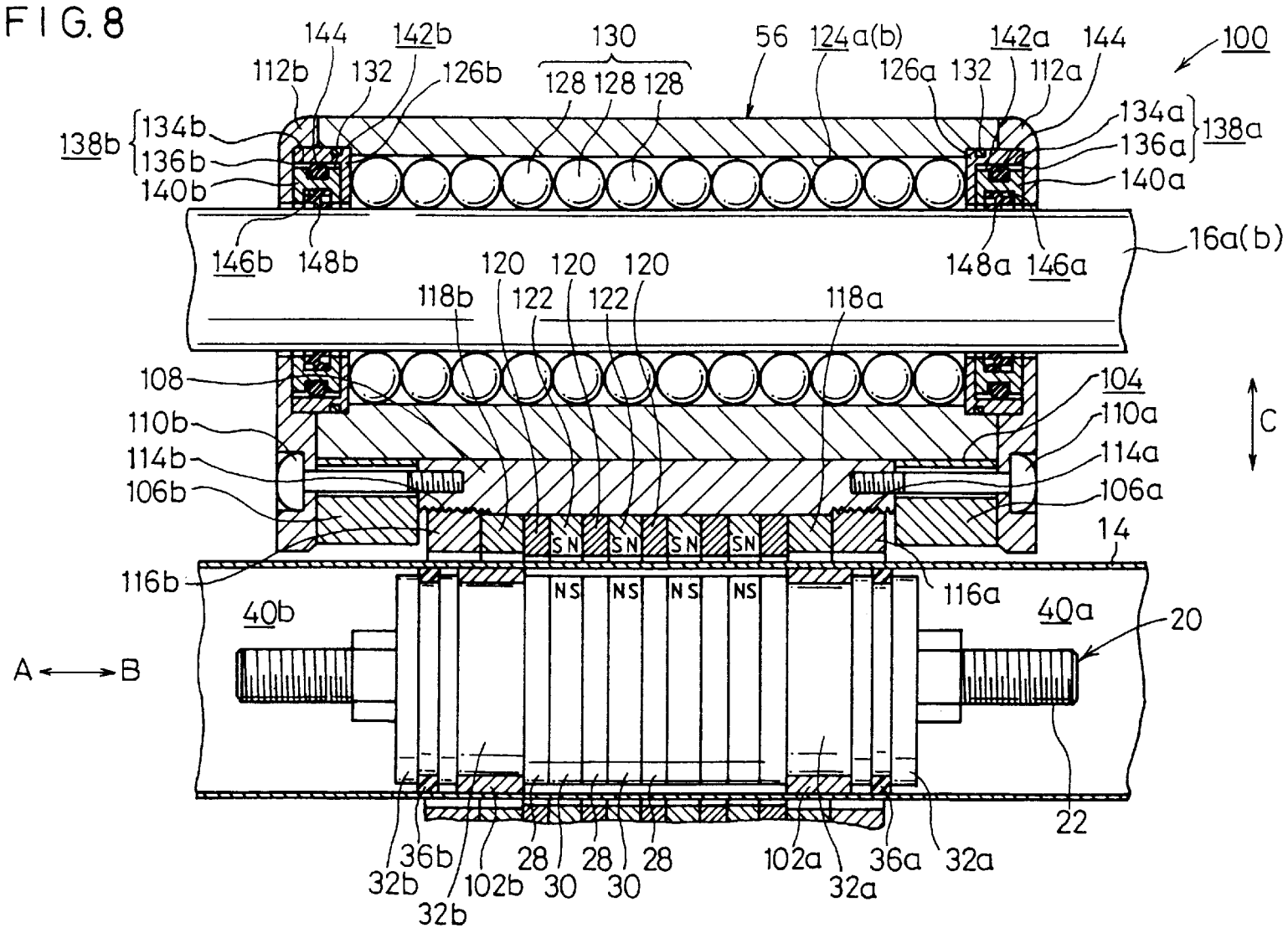
FIG. 8 shows a partial magnified longitudinal sectional view illustrating a piston and a slider of the rodless cylinder shown in FIG. 6.

As shown in FIGS. 6 and 7, a hole 104 is defined through a slider 56 of the rodless cylinder 100. As shown in FIG. 8, a cylindrical member 108 is inserted into an inner wall portion of the hole 104 of the slider 56 together with spacers 106*a*, 106*b*. The cylindrical member 108 is fastened to end plates 112*a*, 112*b* disposed at both ends of the slider 56 by the aid of screws 110*a*, 110*b*. Female screws 114*a*, 114*b* are formed on the inner circumference of the cylindrical member 108 in the vicinity of its openings. Ring members 116*a*, 116*b*, which are formed with male screws on their outer circumference, are screwed into the female screws 114*a*, 114*b*. A plurality of ring members 120, which are formed of a material such as iron, are provided between the ring members 116*a*, 116*b* with ring-shaped spacers 118*a*, 118*b* intervening therebetween. A plurality of driven magnets 122 are interposed by the respective ring members 120. Therefore, the driven magnets 122 are isolated from each other by the ring members 120. Inner wall surfaces of the driven magnets 122 and the ring members 120 are formed to be slightly separated from the outer circumferential surface of the cylinder tube 14. The driven magnets 122 are formed at the same intervals concerning the polarities of the driving magnets 30, each of which has one surface which is formed as the south pole, and the other surface which is formed as the north pole. Therefore, the driven magnets 122 and the driving magnets 30 are constructed to attract and repel each other.

The driven magnets 122 and the ring members 120 are tightly held and interposed between the ring members 116*a*, 116*b* by tightening the ring members 116*a*, 116*b* to the female screws 114*a*, 114*b* of the cylindrical member 108. The cylindrical member 108, on which the driven magnets 122 are provided, is tightly supported by the slider 56 by tightening the screws 110*a*, 110*b*. Therefore, it is possible to eliminate the fear of occurrence of looseness in the driven magnets 122 and the ring members 120.

Holes 124*a*, 124*b*, through which guide shafts 16*a*, 16*b* are inserted, are defined through the slider 56. Ring members 126*a*, 126*b* are disposed at openings of the holes 124*a*, 124*b*. The ring members 126*a*, 126*b* are prevented from disengagement by end plates 112*a*, 112*b*. A ball bush 130, which comprises a large number of balls 128, is provided between the ring members 126*a*, 126*b*. Therefore, the slider 56 is supported on the guide shafts 16*a*, 16*b* by the aid of the ball bushes 130, and it is slidable in the axial direction with less friction.

Alternatively, for example, ball guide passages communicating with the holes 124*a*, 124*b* may be provided in the slider 56 to allow the balls 128 to circulate through the ball guide passages. This arrangement makes it possible to further reduce the sliding resistance of the balls 128, which is preferred.

O-rings 132 are provided on the outer circumference of the ring members 126*a*, 126*b*. Step sections 134*a*, 134*b* are formed on the inner circumference of the ring members 126*a*, 126*b*. Recesses 138*a*, 138*b* are formed by the step sections 134*a*, 134*b* and first wall surfaces 136*a*, 136*b* of the end plates 112*a*, 112*b*. Ring-shaped guide scraper holders 140*a*, 140*b* are fitted to the recesses 138*a*, 138*b*. Gaps 142*a*, 142*b* are formed between the step sections 134*a*, 134*b* of the recesses 138*a*, 138*b* and the outer walls of the guide scraper holders 140*a*, 140*b*. Accordingly, the guide scraper holders 140*a*, 140*b* are displaceable in a direction perpendicular to the axis.

Flexible O-rings (seal members) 144 are provided on the outer circumference of the guide scraper holders 140*a*, 140*b*. On the other hand, guide scrapers 148*a*, 148*b* are engaged with inscribing grooves 146*a*, 146*b* which are formed on the inner circumference of the guide scraper holders 140*a*, 140*b*. The guide scrapers 148*a*, 148*b* are slidable on the outer circumference of the guide shafts 16*a*, 16*b*.

The rodless cylinder 100 according to the third embodiment is basically constructed as described above. Next, its operation, function, and effect will be explained.

The unillustrated solenoid-operated valve is operated to introduce the compressed air into the first port 42, while the second port 50 is in a state open to the atmospheric pressure. Thus, the compressed air is introduced from the first port 42 into the chamber 40*a* of the cylinder tube 14. The pressure of the compressed air allows the piston 20 to slide in a direction indicated by the arrow A (see FIG. 6). Accordingly, the driving magnets 30 are displaced, and they magnetically attract and repel the driven magnets 122. Thus, the slider 56 slides along the guide shafts 16*a*, 16*b* in the direction of the arrow A. During this process, the slight gap is provided between the driven magnets 122 and the outer circumferential surface of the cylinder tube 14, and they are not contacted with each other. Therefore, there is neither sliding resistance nor abrasion, and there is no fear of appearance of dust or the like (see FIG. 8). Further, the driven magnets 122 are tightly held and interposed by the ring members 116*a*, 116*b*, and the cylindrical member 108 on which the driven magnets 122 are provided is also tightly supported by the slider 56. Therefore, there is no appearance of dust or the like, which would be otherwise caused by looseness of the driven magnets 122 and the ring members 120. Furthermore, the slider 56 is supported by the guide shafts 16*a*, 16*b* by the aid of the ball bushes 130. Therefore, the sliding resistance is small, and little dust or the like appears. Moreover, a slight amount of appeared dust or the like, if any, is removed by the guide scrapers 148*a*, 148*b*. Thus, there is no fear of scattering of the dust or the like to the outside of the rodless cylinder 100.

Subsequently, the unillustrated solenoid-operated valve is operated so that the first port 42 is in a state open to the atmospheric air, and the compressed air is introduced into the second port 50. Accordingly, the compressed air is introduced into the chamber 40*b*, and the piston 20 slides in a direction of the arrow B. As a result, the driven magnets 122 are attracted by the driving magnets 30, and the slider 56 is displaced in the direction of the arrow B in the same manner as described above.

When the rodless cylinder 100 is assembled, any assembling error occasionally causes the guide shafts 16*a*, 16*b* to be slightly deviated or inclined in the direction perpendicular to the axial direction. That is, the central axes of the guide shafts 16*a*, 16*b* are not coincident with the central axes of the holes 124*a*, 124*b* of the slider 56 in some cases. Further, it is feared that the guide shafts 16*a*, 16*b* are warped, for example, due to a load of a workpiece. In such a situation, for example, if the guide shaft 16*a*, 16*b* is displaced with respect to the slider 56 in a direction of the arrow C in FIG. 8, the guide scraper 148*a*, 148*b* is pressed by the guide shaft 16*a*, 16*b* in the direction of the arrow C. During this process, the O-ring 144 is deformed, and the guide scraper holder 140*a*, 140*b* slides on the wall surface 136*a*, 136*b* of the recess 138*a*, 138*b* to make displacement in the direction of the arrow C. Therefore, the central axis of the guide scraper 148*a*, 148*b* is always coincident with the central axis of the guide shaft 16*a*, 16*b*. The guide scraper 148*a*, 148*b* is capable of retaining uniform gripping force for the guide shaft 16*a*, 16*b*. Accordingly, there is no fear of increase in sliding resistance to cause any trouble concerning the displacement action of the slider 56. Further, any large force is not exerted on a part of the guide scraper 148*a*, 148*b*. Therefore, the guide scraper 148*a*, 148*b* is not locally worn, making it possible to avoid generation of dust from the guide scraper 148*a*, 148*b*.

As described above, even when the guide shafts 16*a*, 16*b* suffer from occurrence of any assembling error, or even when they are warped, the guide scrapers 148*a*, 148*b* are displaceable along the guide shafts 16*a*, 16*b* in the direction perpendicular to the axis. Therefore, it is unnecessary to assemble the slider 56 and the guide shafts 16*a*, 16*b* of the rodless cylinder 100 with a high degree of accuracy. Thus, it is possible to reduce the production cost of the rodless cylinder 100.

The dust or the like is removed by the guide scrapers 148*a*, 148*b*. Therefore, there is no fear of scattering of the dust or the like to the outside of the rodless cylinder 100. The rodless cylinder 100 can be used, for example, for those concerning the medical field and food as well as clean rooms used to execute the steps of producing semiconductors.

Figure 9:
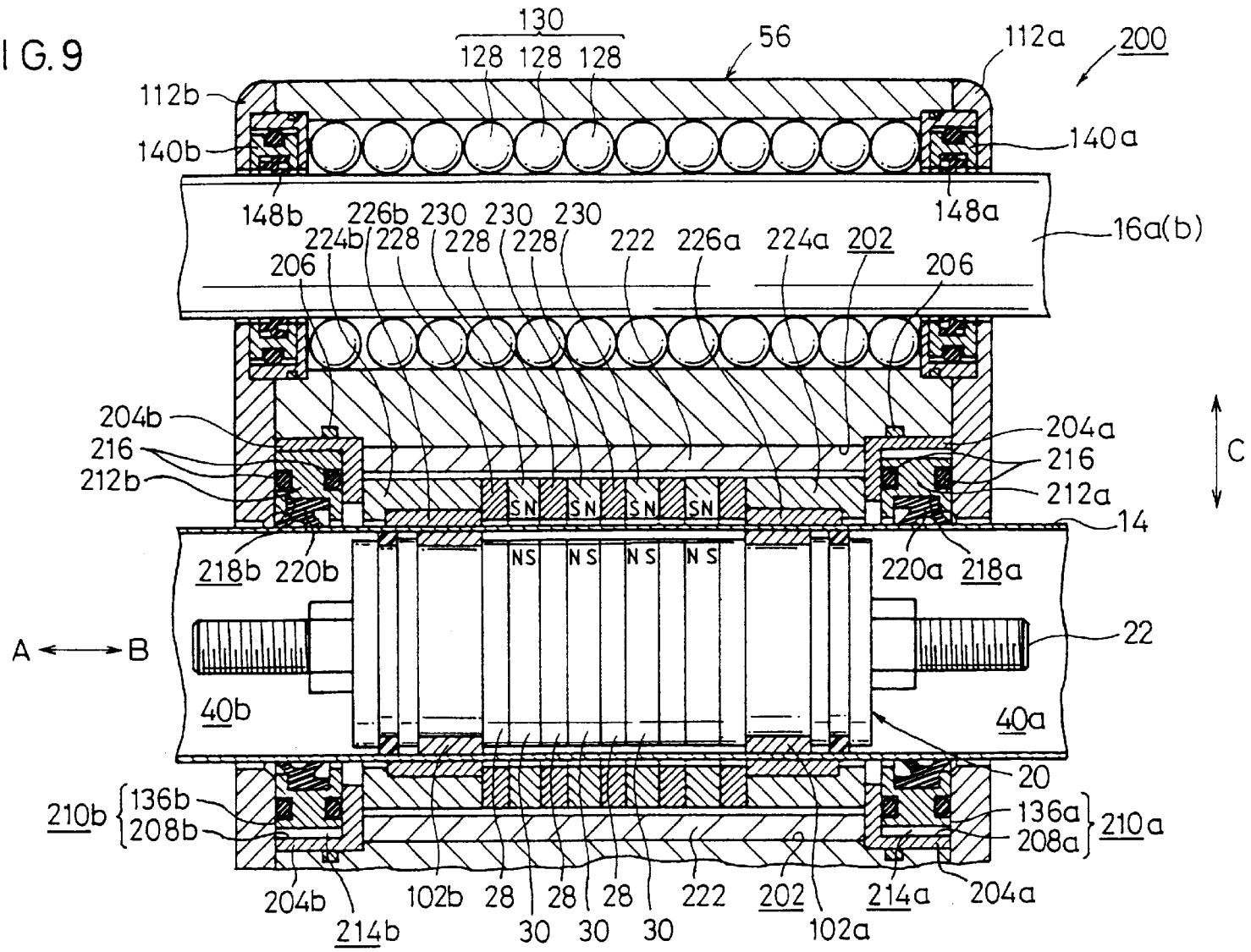
FIG. 9 shows a partial magnified longitudinal sectional view illustrating a piston and a slider of a rodless cylinder according to a fourth embodiment of the present invention.

Next, a rodless cylinder 200 according to a fourth embodiment will be explained with reference to FIG. 9.

A hole 202, through which a cylinder tube 14 is inserted, is formed through a slider 56 of the rodless cylinder 200. Ring members 204*a*, 204*b* are provided at openings of the hole 202. O-rings 206 are provided on the outer circumference of the ring members 204*a*, 204*b*. Step sections 208*a*, 208*b* are formed on the inner circumference of the ring members 204*a*, 204*b*. Recesses 210*a*, 210*b* are formed by the step sections 208*a*, 208*b* and first wall surfaces 136*a*, 136*b* of end plates 112*a*, 112*b*. Ring-shaped cylinder scraper holders 212*a*, 212*b* are fitted to the recesses 210*a*, 210*b*. Gaps 214*a*, 214*b* are formed between the step sections 208*a*, 208*b* of the recesses 210*a*, 210*b* and the cylinder scraper holders 212*a*, 212*b*. Therefore, the cylinder scraper holders 212*a*, 212*b* are displaceable in a direction (direction indicated by the arrow C) perpendicular to the axis. O-rings 216 are provided on both side surfaces of the cylinder scraper holders 212*a*, 212*b*. On the other hand, cylinder scrapers 220*a*, 220*b* are engaged with inscribing grooves 218*a*, 218*b* formed on the inner circumference of the cylinder scraper holders 212*a*, 212*b*. The cylinder scrapers 220*a*, 220*b* are slidable on the outer circumference of the cylinder tube 14.

A cylindrical member 222 is provided between the ring members 204*a*, 204*b* in the hole 202. Spacers 224*a*, 224*b*, which are slightly separated from the inner circumference of the cylindrical member 222, are arranged in the cylindrical member 222. The spacers 224*a*, 224*b* are slidable in a direction perpendicular to the axis with respect to the ring members 204*a*, 204*b*. Bushes 226*a*, 226*b*, which are slidable on the cylinder tube 14, are provided on the inner circumference of the spacers 224*a*, 224*b*. A plurality of ring members 228, which are formed of a material such as iron, are arranged between the spacers 224*a*, 224*b*. The respective ring members 228 interpose a plurality of driven magnets 230. Therefore, the respective driven magnets 230 are isolated from each other by the ring members 228. The driven magnets 230 and the ring members 228 are supported by the aid of the bushes 226*a*, 226*b* so that the inner circumference thereof is slightly separated from the outer circumference of the cylinder tube 14.

Next, the operation, function, and effect of the rodless cylinder 200 according to the fourth embodiment will be explained.

The rodless cylinder 200 is operated in the same manner as the rodless cylinder 10 according to the first embodiment. That is, when the compressed air is introduced into the first chamber 40*a*, then the piston 20 is displaced in the direction of the arrow A, and the driven magnets 230 are attracted by the driving magnets 30. Thus, the slider 56 is displaced in the direction of the arrow A. When the compressed air is introduced into the second chamber 40*b*, the slider 56 is displaced in the direction of the arrow B.

During this process, since the driven magnets 230 are supported by the bushes 226*a*, 226*b*, the gap between the driven magnets 230 and the outer circumference of the cylinder tube 14 is merely in a slight amount. The force for being attracted by the driving magnets 30 is increased. However, since the bushes 226*a* 226*b* contact with the cylinder tube 14, any dust may be generated due to the friction between the both. Further, if there is any looseness in the assembled structure, for example, of the driven magnets 230 and the ring members 228, any dust may be generated from such components. However, even in the case of the structure in which the cylinder tube 14 contacts with the bushes 226*a*, 226*b* as described above, the dust or the like is removed by the cylinder scrapers 220*a*, 220*b*. Therefore, the dust which is generated due to the sliding movement of the cylinder tube 14 and the bushes 226*a*, 226*b*, and the dust or the like which is generated due to the looseness of the driven magnets 230 and the ring members 228 are prevented from outflow to the outside of the rodless cylinder 200.

Any deviation may occur between the central axis of the cylinder tube 14 and the central axis of the hole 202 of the slider 56 due to any assembling error caused when the rodless cylinder 200 is assembled. The cylinder tube 14 may He be warped, for example, by a load of a workpiece. In such a situation, for example, if the cylinder tube 14 is displaced in the direction of the arrow C shown in FIG. 9 with respect to the slider 56, then the cylinder scrapers 220*a*, 220*b* are pressed by the cylinder tube 14 in the direction of the arrow C, and the cylinder scraper holders 212*a*, 212*b* slide on the wall surfaces 136*a*, 136*b* and the step sections 208*a*, 208*b* of the recesses 210*a*, 210*b* to make displacement in the direction of the arrow C. Therefore, the central axis of the cylinder scraper 220*a*, 220*b* is always coincident with the central axis of the cylinder tube 14. The cylinder scraper 220*a*, 220*b* is capable of retaining uniform gripping force for the cylinder tube 14. Accordingly, there is no fear of increase in sliding resistance to cause any trouble concerning the displacement action of the slider 56. Further, the cylinder scraper 220*a*, 220*b* is prevented from being locally worn, which would otherwise cause generation of dust.

In this embodiment, when the bushes 226*a*, 226*b* are pressed in the direction of the arrow C by the cylinder tube 14, the spacers 224*a*, 224*b* slide on the ring members 204*a*, 204*b* to make displacement in the direction of the arrow C. Accordingly, the driven magnets 230 do not make contact with the outer circumference of the cylinder tube 14. The dust generation is avoided, which would be otherwise caused by the contact between the driven magnets 230 and the cylinder tube 14. Further, the bushes 226*a*, 226*b* make it possible to retain the gap to be in an extremely slight amount between the driven magnets 230 and the outer circumference of the cylinder tube 14.

Therefore, even if any assembling error occurs in the cylinder tube 14, or even if the cylinder tube 14 is warped, the dust or the like is removed by the cylinder scrapers 220*a*, 220*b*. Accordingly, there is no fear of scattering of the dust or the like to the outside of the rodless cylinder 200. The rodless cylinder 200 can be used, for example, for those concerning the medical field and food as well as clean rooms to executed the steps of producing semiconductors. It is unnecessary to assemble the cylinder tube 14 of the rodless cylinder 200 with a high degree of accuracy. Accordingly, it is possible to reduce the production cost of the rodless cylinder 200.

In the rodless cylinder 200 according to the fourth embodiment, the O-rings 216 are provided on the both side surfaces of the cylinder scraper holders 212*a*, 212*b*. Alternatively, flexible O-rings may be provided on the outer circumference of the cylinder scraper holders 212*a*, 212*b*.

Figure 10:
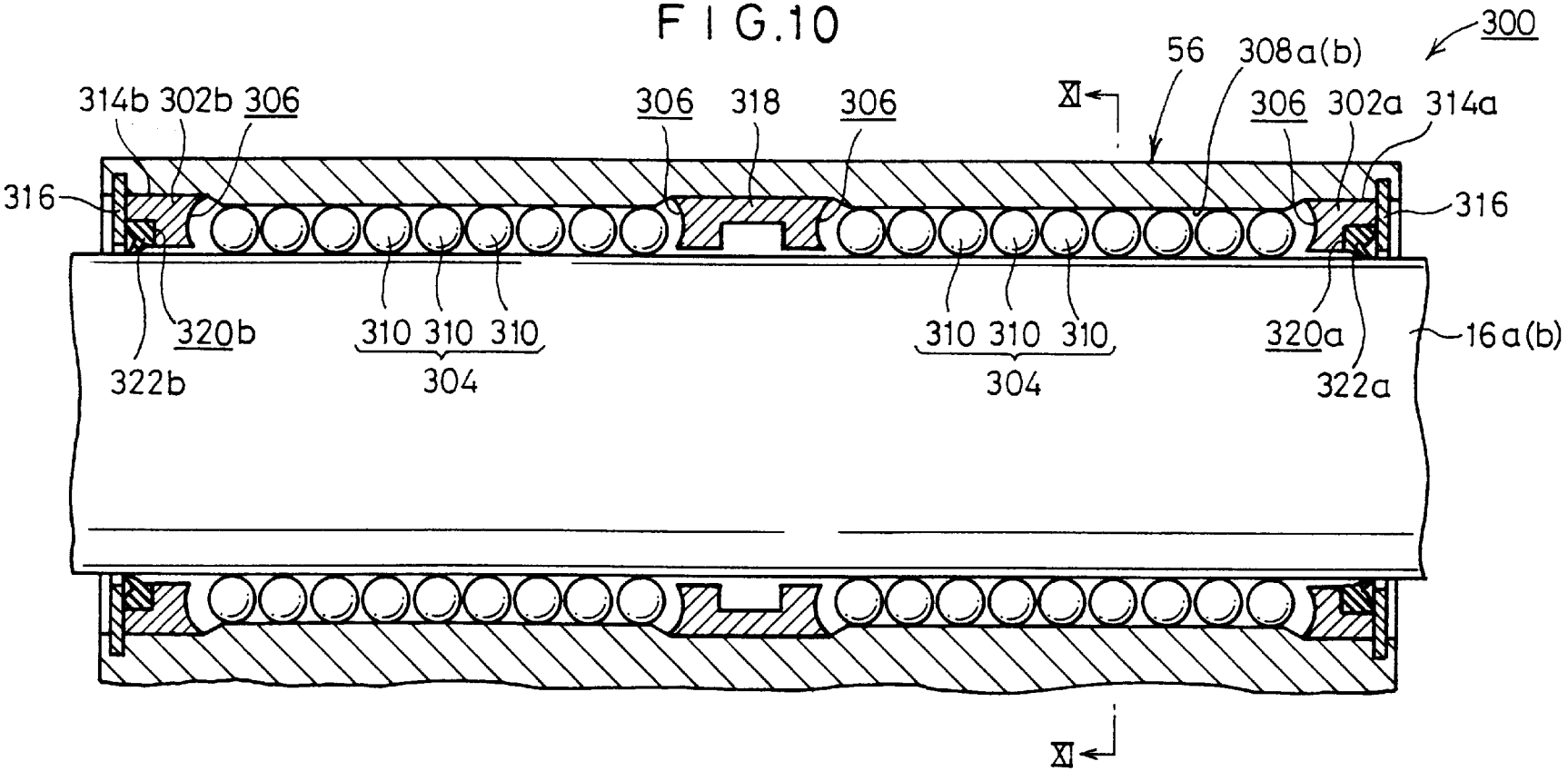
FIG. 10 shows a partial magnified longitudinal sectional view illustrating a slider of a rodless cylinder according to a fifth embodiment of the present invention.

Next, a rodless cylinder 300 according to a fifth embodiment will be explained with reference to FIG. 10.

In the rodless cylinder 300, guide scraper holders 302*a*, 302*b* are formed with ball-rolling grooves 306 for ball bushes 304. This arrangement will be described in detail below. Holes 308*a*, 308*b*, through which guide shafts 16*a*, 16*b* are inserted, are defined through a slider 56. The ball bushes 304, which include a large number of balls 310, are provided in the gap between the wall for constructing the hole 308*a*, 308*b* and the outer wall of the guide shaft 16*a*, 16*b*. Diametrally expanded sections 314*a*, 314*b* are formed on the wall of the hole 308*a*, 308*b* in the vicinity of openings. Guide scraper holders 302*a*, 302*b*, which are formed to have a ring-shaped configuration, are inserted into the diametrally expanded sections 314*a*, 314*b*. The guide scraper holders 302*a*, 302*b* are prevented from disengagement by the aid of ring members 316. A ball-retaining member 318, which is formed to have a ring-shaped configuration, is secured to an approximately central portion of the wall for forming the hole 308*a*, 308*b*. The ball-rolling grooves 306, which have a substantially circular arc-shaped cross section, are formed on the guide scraper holders 302*a*, 302*b* and the ball-retaining member 318. Step sections 320*a*, 320*b* are formed on the guide scraper holders 302*a*, 302*b*. The guide scrapers 322*a*, 322*b* are interposed by the step sections 320*a*, 320*b* and the ring members 316.

Figure 11:
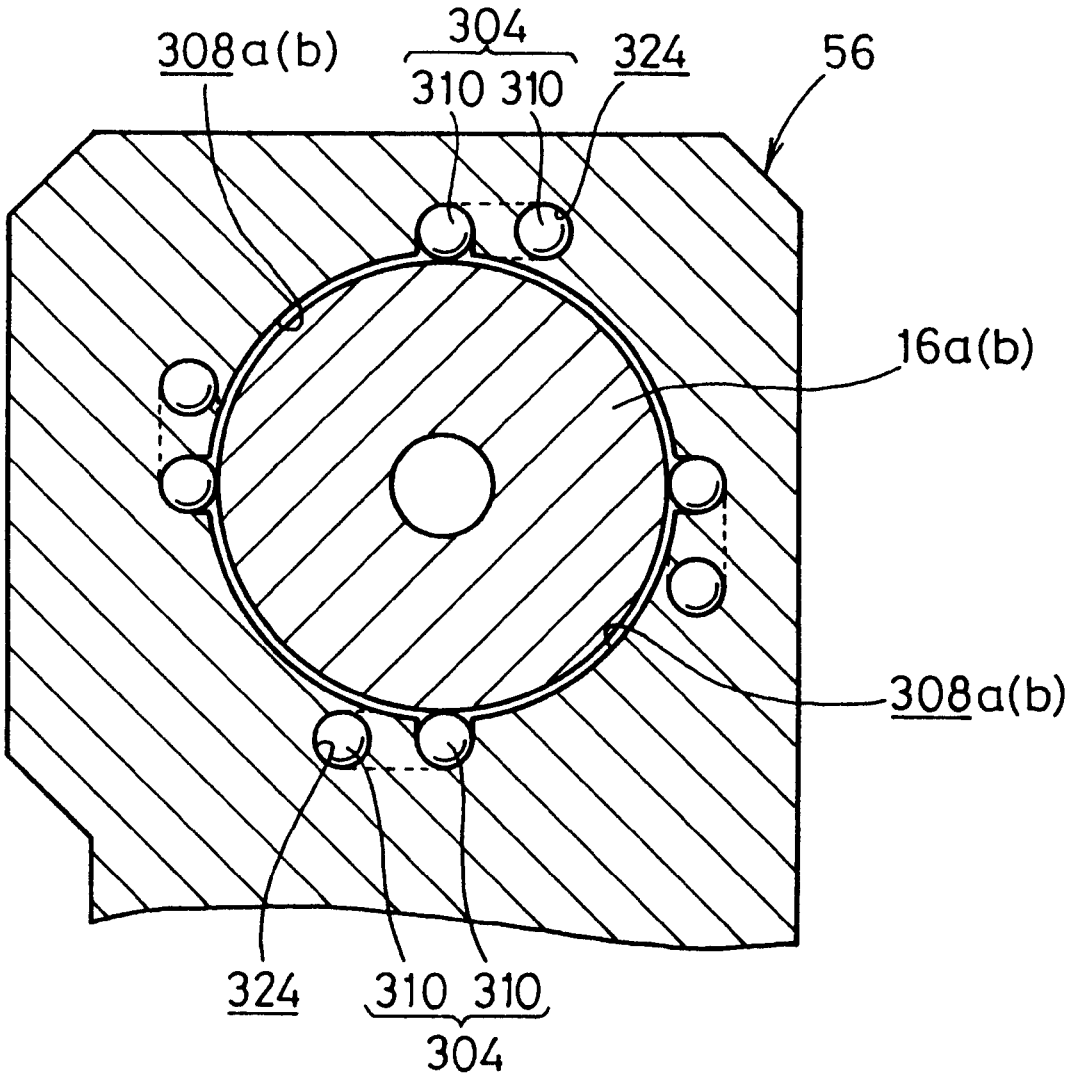
FIG. 11 shows a sectional view taken along a line XI—XI illustrating the slider shown in FIG. 10.

As shown in FIG. 11, the ball-rolling grooves 306 communicate with ball guide passages 324 formed in the slider 56. In this embodiment, the balls 310 are movable in a circulating manner between the hole 308*a*, 308*b* and the ball guide passages 324. Accordingly, the slider 56 is displaced with less sliding resistance with respect to the guide shafts 16*a*, 16*b*. The dust or the like, which is generated in a slight amount between the guide shafts 16*a*, 16*b* and the ball bushes 304, is removed by the guide scrapers 322*a*, 233*b*. There is no fear of scattering of the dust or the like to the outside of the rodless cylinder 300. Further, the number of parts for constructing the rodless cylinder 300 is decreased, and it is possible to reduce the production cost.

What is claimed is:

1. A rodless cylinder comprising:

a cylindrical cylinder tube;

a piston which is arranged in said cylinder tube and which is displaceable along a longitudinal direction of said cylinder tube;

a driving magnet arranged on said piston;

a guide member provided in parallel to said cylinder tube;

a slider which is slidably supported by said guide member and which is provided with a hole through which said cylinder tube is insertable, said slider further comprising a guide scraper for making sliding contact with said guide member and a guide scraper holder disposed displaceably with respect to said slider and being displaceable in a direction perpendicular to a longitudinal axis of said guide member; and a driven magnet which is provided on a wall for forming said hole of said slider and which is arranged to be slightly separated from said cylinder tube.

2. The rodless cylinder according to claim 1, wherein said guide member is provided as two or more individuals.

3. The rodless cylinder according to claim 1, wherein said slider is provided with a ball bush for supporting said guide member.

4. The rodless cylinder according to claim 1, wherein a gap for allowing said guide scraper to be displaceable with respect to said slider is formed adjacent to said scraper holder.

5. The rodless cylinder according to claim 4, wherein a seal member formed of a flexible material is provided in said gap.

6. The rodless cylinder according to claim 1, wherein said slider is provided with a ball bush for supporting said guide member, a guide scraper holder for holding said guide scraper is formed with a ball groove which communicates with a ball guide passage formed in said slider, and balls for constructing said ball bush circulate through said ball groove between a gap formed between said slider and said guide member and said ball guide passage.

7. A rodless cylinder comprising:

a cylindrical cylinder tube;

a piston which is arranged in said cylinder tube and which is displaceable along a longitudinal direction of said cylinder tube;

a driving magnet arranged on said piston;

a guide member provided in parallel to said cylinder tube;

a driven magnet which is provided on a wall for forming a hole of a slider and which is arranged to be slightly separated from said cylinder tube; and wherein said slider is slidably supported by said guide member and is provided with said hole through which said cylinder tube is insertable, wherein said slider is arranged with a cylinder scraper for making sliding contact with the cylinder tube, said slider further comprising a cylinder scraper holder displaceable with respect to said slider independently of said driven magnet and further being displaceable in a direction perpendicular to a longitudinal axis of said cylinder tube, for supporting said cylinder scraper.

8. The rodless cylinder according to claim 7, wherein a gap for allowing said cylinder scraper to be displaceable with respect to said cylinder tube is formed adjacent to said cylinder scraper holder.

9. The rodless cylinder according to claim 8, wherein a seal member formed of a flexible material is provided in said gap.

* * * * *